United States Patent [19]

Rogers et al.

[11] Patent Number: 4,457,813

[45] Date of Patent: Jul. 3, 1984

[54] ELECTROLYSIS CELLS AND ELECTROLYTIC PROCESSES

[75] Inventors: Thomas E. Rogers, Manchester; Robert E. Jansson, Chesterfield, both of Mo.; Manuel M. Baizer, Santa Barbara, Calif.

[73] Assignee: Monsanto Company, St. Louis, Mo.

[21] Appl. No.: 472,354

[22] Filed: Mar. 4, 1983

[51] Int. Cl.[3] ..... C25B 3/00; C25B 3/02

[52] U.S. Cl. ..... 204/74; 204/75; 204/76; 204/77; 204/78; 204/79; 204/59 R; 204/73 R; 204/128; 204/129

[58] Field of Search ..... 204/74, 75, 76, 77, 204/78, 79, 73 R, 59 R, 128, 129

[56] References Cited

U.S. PATENT DOCUMENTS

| | | | |
|---|---|---|---|
| 2,055,962 | 2/1935 | Boss | 204/59 R |
| 3,288,692 | 11/1966 | Leduc | 204/80 |
| 3,427,235 | 2/1969 | Leduc | 204/78 |
| 3,660,255 | 5/1972 | Fox et al. | 204/59 |
| 3,728,233 | 6/1968 | Ashe, Jr. et al. | 204/59 |
| 4,191,619 | 3/1980 | Struck | 210/8.5 |
| 4,256,551 | 3/1981 | Cliff et al. | 204/98 |

OTHER PUBLICATIONS

J. Electrochem Society, vol. 123, p. 809+, Baizer & Hallcher (1976), Paired Electro-Organic Syntheses.

Chemistry and Industry, pp. 670-672 (Oct. 1979). The Producton of Propylene Oxide in a Bipolar Tricle Tower.

J. Electrochem. Soc. vol. 128, No. 9-pp. 1885-1889 (1981), The Effect of Mixing in Paired Dimerizations.

J. Chem. Tech. Biotechnol., 1980, 30, 200-204, The Effect of Mixing on the Paired Dimerisations of Methyl Acrylate and Diethyl Malonate.

J. Applied Electrochemistry 13 (1983) 651-656 K. G. Ellis, R. E. W. Jansson, Selectivity in the Electrochemical Epoxidation of Propylene.

J. of Applied Electrochemistry 13 (1983) 657-661-Ellis & Jansson, The Indirect Electrochemical Epoxiation of Butenes and Ethylene in a Bipolar Tower.

Kirk-Othmer, Encyclopedia of Chemical Technology, Third Edition, vol. 1, pp. 807-817.

*Primary Examiner*—John F. Niebling

*Attorney, Agent, or Firm*—Joseph D. Kennedy; James W. Williams, Jr.

[57] ABSTRACT

Electrolytic processes in which separate useful reactions are conducted at an anode and cathode, respectively, by electrolysis of an anolyte at an anode and a catholyte at the cathode wherein the anolyte and catholyte are of different composition and are prevented from contacting the cathode and anode, respectively, during electrolysis without the use of selective permeable membranes or permeable partitions.

10 Claims, 4 Drawing Figures

ELECTROLYSIS CELLS AND ELECTROLYTIC PROCESSES

BACKGROUND OF THE INVENTION

It has been customary in the past to carry out an electrolysis procedure in which the desired product (s) are produced at one electrode (commonly referred to as the working electrode) while at the other (or counter) electrode a sacrificial reaction is carried out. For example, in the commercially practiced electrohydrodimerization (EHD) of an activated olefin such as acrylonitrile to adiponitrile, as in Equation 1 infra, wherein the useful product is produced at the cathode, the counter reaction (at the anode) is the sacrificial oxidation of water.

$$2H_2C{=}CHR \rightarrow R(CH_2)_4R \qquad \text{(Equation 1)}$$

where R=—CN,—$CO_2Me$,—$CO_2Et$, etc.

This reaction results in only 50% of the total electric power supplied to the cell being utilized for producing a useful synthetic product.

The efficiency (power utilization) of electrochemical processes could be greatly enhanced if the sacrificial reaction occurring at the counter electrode could be replaced with a useful reaction at such electrode where a useful product would be produced. An example of such a useful reaction in combination with that of Equation 1 would be an anodic Kolbe or Crum-Brown-Walker (CBW) reaction in which, for example, a monoester adipate undergoes decarboxylative dimerization to form a diester sebacate as in Equation 2 which follows:

Equation 2

$$2'R'O_2C(CH_2)_4CO_2H \xrightarrow[-2H]{-2e} R'O_2C(CH_2)_8CO_2R'$$

where R'=alkyl.

Normally, when the CBW reaction is carried out in an electrolysis cell, the sacrificial reaction that is carried out at the cathode is the conversion of water to hydrogen and hydroxide when water is the electrolyte medium or the conversion of methanol to hydrogen and methoxide when methanol is the electrolyte medium.

The EHD reaction of activated olefin, as above, in the normal electrochemical mode, where the oxidation of water is used as the sacrificial anodic reaction, is carried out in aqueous solution at a pH of about 8–10 and requires the use of an electrolyte containing $R_4N^+$ moieties. Such reaction usually gives hydrodimerized olefin yields of about 90% with current efficiencies of about 80–85%.

On the other hand, the CBW reaction is generally carried out in methanol (water can be used but the current efficiency is only about 35%) using a platinum or vitreous carbon anode together with an alkali metal or $R'_4N^+$ cation and at a pH of about 3 to 4. Using these conditions the yield of dimer is about 90% and the current efficiency is about 65%. Generally the presence of anions other than the carboxylate in the CBW reaction will suppress the formation of the desired radical intermediate.

Attempts to carry out the above electrolytic reactions simultaneously in an undivided cell using aqueous acetonitrile as the electrolyte resulted in the producition of at least 23 different products in approximately equal amounts. Moreover, attempts to convert acrylate to adipate at the cathode and a monoalkyl adipate to a dialkyl sebacate at the anode of an undivided cell results in the trapping of intermediate CBW radicals (e.g., $MeO_2C(CH_2)_4CH_2\cdot$) by activated olefin (acrylate) to give unwanted radical addition products.

In so far as we are aware, the only electrolytic systems capable of functioning to produce simultaneously products of the kind referred to above at both the anode and cathode, while substantially avoiding the formation of undesirable by-products, has been by the use of an electrolytic cell containing a selective permeable membrane or diaphragm which separates the anolyte from the catholyte and thus prevents the anolyte from contacting the cathode and the catholyte from contacting the anode. While satisfactory electrolytic reactions can be achieved by such an arrangement, the resultant apparatus is not as efficient as desired because the membrane increases the voltage loss, therefore decreasing the power utilization, and thus reducing the product production per unit of power utilized. Also additional equipment is required to be used with the cell to control the electrolytic process. In addition, the special membranes required in such a process add to the cost of the equipment and impose an economic penalty on the practice of the process.

There are also known processes in which events occurring at both electrodes are involved in production of a particular product, e.g. propylene oxide is prepared from propylene in an electrolysis involving oxidation of halide to halogen at the anode and reduction of water to obtain hydroxyl ion at the cathode, with both the halogen and hydroxyl being involved in epoxidation of the olefin. However, in such processes there is generally no provision for keeping materials separated since both anodic and cathodic products must contact the organic reactant material. Moreover, a single useful product is produced, rather than useful products at both electrodes.

U.S. Pat. No. 4,191,619 to Bernd D. Struck issued Mar. 4, 1980 proposes the use of an electrolytic cell which accomplishes some of the benefits of the prior art membrane partitioned cells by substituting cheaper materials for separating the anolyte and catholyte fluids, but nevertheless requires the use of an electrolytic cell which is more complicated and expensive than is desired, and this translates into a process which is burdened with a higher capital and maintenance cost.

The present invention, therefore, has the object of providing simple electrolytic cells which enable the practice of processes such as referred to above, in which useful products are produced at both electrodes without the use of special costly permeable membranes, permeable diaphragms and/or partitions thereby effecting a saving in cell cost and operation. Another object of this invention is to provide electrolytic processes utilizing such simple electrolytic cells.

SUMMARY OF THE INVENTION

The present invention provides an electrolytic cell, specifically a diaphragmless cell, and various modifications thereof, in which the novel electrolytic processes of this invention can be carried out. By diaphragmless cell is meant a cell which does not contain a membrane or porous diaphragm which separates the cell into 2 compartments. Before describing such processes, description of some of the more suitable cells and variations thereof will be made in relation to the accompanying drawings.

Porous electrodes, as used in this invention, are well known in the art (for example, see U.S. Pat. No. 3,427,235 issued Feb. 11, 1969, which patent is hereby incorporated by reference).

Figure 1:
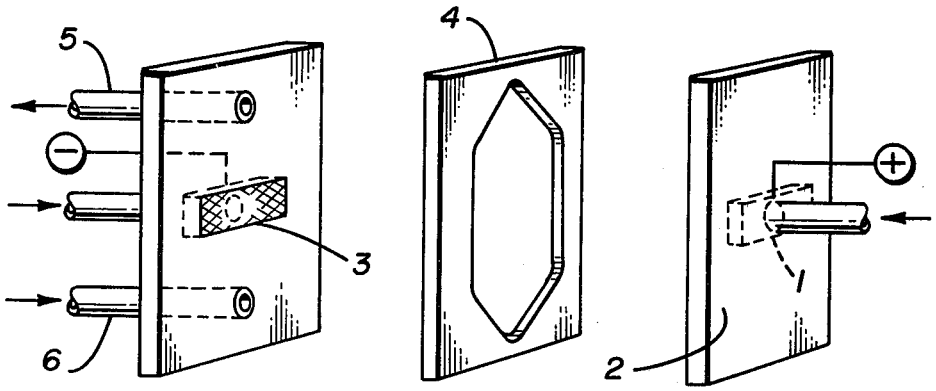
FIG. 1 illustrates, in exploded relation, electrode arrangements in a preferred form of electrolytic cell in accordance with the present invention together with the flow direction of anolyte, catholyte and supplemental electrolyte through the cell.

The cell in FIG. 1 can be constructed of any suitable material as will be apparent to one skilled in the art—for example, polypropylene or polyethylene is suitable and can be used to form the other walls of the cell which are not illustrated. In this cell the anolyte is supplied through the porous anode 1 which is positioned on one wall 2 of the cell about midway of the cell height and directly opposite the porous cathode 3 of the cell. Catholyte is supplied to the cell through the porous cathode. Positioned inside the cell body and spaced equidistant between the anode and cathode is a cell frame 4. This frame is a sheet of material machined internally to provide a flow distributor, which produces laminar flow of the electrolytes over their respective electrodes, a laminar flow section in the electrode area wherein the liquid flow is laminar or substantially so, and an exit section to accelerate the liquid flow towards the cell exit without creating substantial disturbance of the flow. . The anolyte and catholyte products can be withdrawn from the top of the cell, either through the same exit line 5 as illustrated, or as separate product streams. Also the cell is provided with solvent electrolyte through an inlet 6 near the bottom of the flow distributor 4. The supply of solvent electrolyte through this inlet serves to aid in preventing the intermixing or intermingling of the anolyte and catholyte in the cell.

With regard to the cell frame shown in FIG. 1, it should be noted that it is designed to prevent substantially turbulent flow conditions from occuring in the cell, or stated differently, the cell frame is designed to maintain laminar flow within the cell. The design criteria to obtain such flow are well known to those skilled in the electrolytic cell construction art. Generally, laminar flow may be defined as a flowing liquid having a Reynold's number less than 2000.

The purpose of the laminar flow is to prevent substantially mixing of the anolyte and catholyte streams until they have passed their respective anode and cathode areas. It might be noted that such streams can be allowed to mix or be maintained separate after they have passed the electrodes, that is, downstream from the electrodes.

Figure 2:
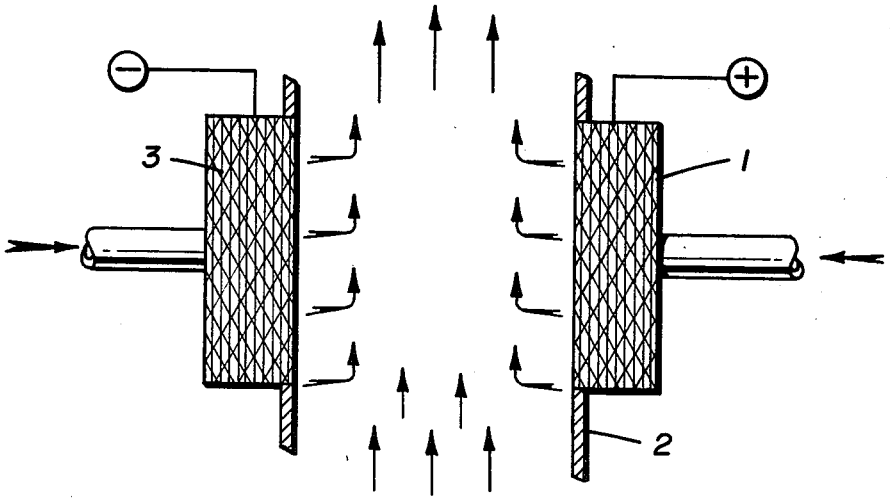
FIGS. 2, 3 and 4 illustrate in side elevation cross-section, other forms of cells, electrode arrangement and anolyte, catholyte and supplemental electrolyte flow direction in accordance with the present invention.

The cell illustrated in FIG. 2 is the same as that described in FIG. 1 except that the flow pattern of the anolyte, catholyte and solvent electrolyte streams is illustrated in greater detail.

Figure 3:
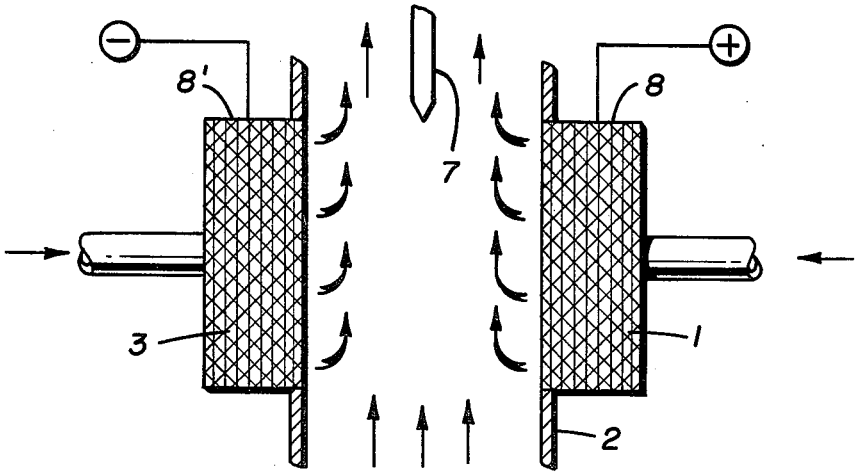

The cell illustrated in FIG. 3 is substantially the same as ilustrated in FIG. 1 but also has an impervious partial partition the front edge of which is positioned at the downstream edges 8 and 8′ of the anode and cathode, and serves to keep the anolyte product stream and catholyte product stream separated from each other and separately collectible, while the solvent electrolyte flow serves the purpose referred to in the discussion of FIG. 1. This is the preferred mode of operation, especially if the anolyte and catholyte products are difficult to separate from the same stream.

Figure 4:
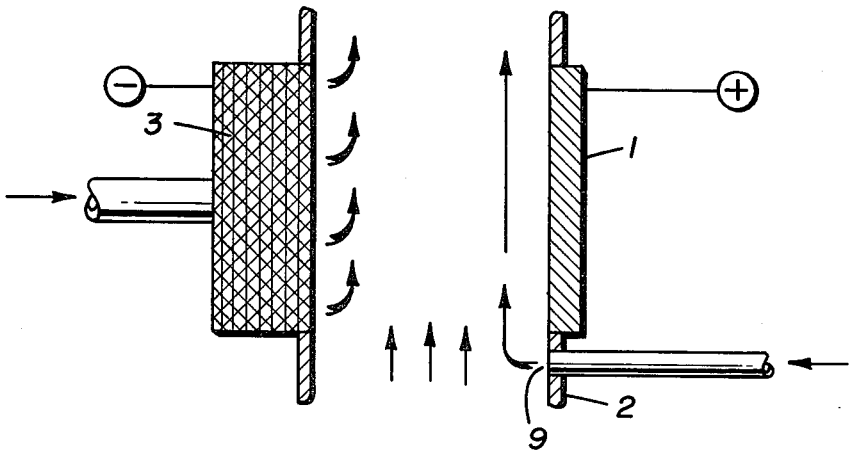

FIG. 4 is an illustration of a cell which is substantially the same as in FIG. 2 except that it is provided with a thin solid, planar electrode 1 (serving as the anode), for example, a planar platinum electrode, and anolyte is supplied to the cell at inlet 9 just before the upstream edge of the anode and passes in contact with the planar anode as it rises to the top of the cell. Although not illustrated, it is possible to employ a cell having a planar cathode and a porous anode or a planar anode and a planar cathode provided electrolyte for such planar electrodes is supplied just prior to contact of the electrolyte with the planar electrode.

The cell body used in practising the invention can be made of any suitable materials as known to those skilled in this art, and the only requisite for such materials is that they contain the electrolytes used and do not react with the electrolytes or any components thereof. As previously noted, plastics such as polypropylene and polyethylene are particularly suitable cell body materials. Although the cells illustrated show an upward electrolyte flow, such cells can be designed and used so that the electrolyte (including anolyte and catholyte) flow is horizontal, downward, etc.

The present process can be used to produce a variety of different products—one being produced at the anode and one at the cathode, and both being produced without any substantial production of undesired by-products. A special case may involve formation of the same product at anode and cathode, but from separate and different reactions. This invention, as indicated above, is especially suitable for producing a dimer of an activated olefin such as the hydrodimer (adiponitrile) of acrylonitrile or the hydrodimer of an alkyl acrylate (such as ethyl acrylate) at the cathode, and the simultaneous production of a dialkyl ester of an ethanedioic acid from a monoalkyl ester of a lower alkane dioic acid at the anode. While the invention is particularly described in relation to the foregoing starting materials and products, it is not so limited and can be used to practice a large variety of electrolytic reactions. Thus, the invention can be used to carry out a large number of paired electrolytic reactions in which the anolyte contains a compound to be oxidized (for example, A−x electrons→B) and the catholyte contains a compound to be reduced (for example, C+x electrons→D), and the contacting of each compound A and C with the wrong electrode would result in the formation of unwanted products of by-products. It is possible, for example, to employ laudanosine in the anolyte and convert it to O-methylflavinantine or to use furan in the anolyte and convert it in the presence of bromine to

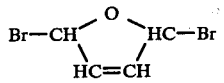

and in the presence of methyl alcohol to

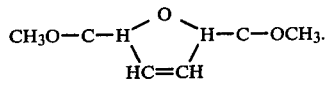

In both instances the catholyte could contain, for example, an activated olefin such as an acrylate or acrylonitrile to be hydrodimerized. As examples of other electrolytic oxidative reactions which can be carried out at the anode in accordance with the present invention are the following:

1. Halide ions $\longrightarrow$ halogen $2\,X^- \xrightarrow{-2e} X_2$

2.

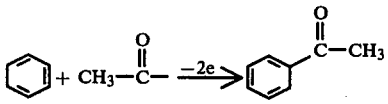

benzene

3.

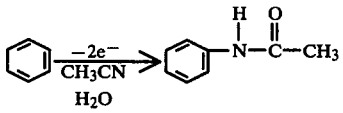

benzene

4. Bis-decarboxylation

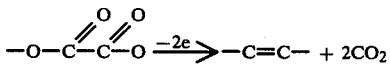

5. $2\,SO_4^= \xrightarrow{-2e} S_2O_8^=$

6. $Ar{-}CH_2{-}\underset{\underset{R}{|}}{N}{-}CH_3 \xrightarrow[\text{methanol}]{-2e^-} Ar{-}CH_2{-}\underset{\underset{CH_3}{|}}{N}{-}CH_2{-}OCH_3$ where Ar is aryl and R is alkyl 7. $2\,Ar\,NH_2 \xrightarrow[\text{methanol}]{-2e^-} Ar{-}N{=}N{-}Ar$ where Ar is aryl

8.

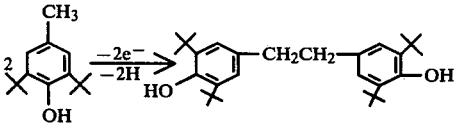

4-hydroxy tolulyl compound

9.

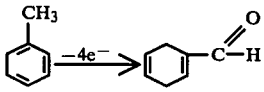

toluene

10. Glucose $\longrightarrow$ gluconate

11.

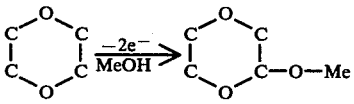

12. $2\,RSH \xrightarrow{NeO^-Na^+} R{-}S{-}S{-}R$ where R is alkyl

13.

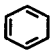

benzene

14. $ArH \xrightarrow[CN^-]{-2e^-} ArCN$ where Ar is aryl

-continued

15. Mn (II) $\longrightarrow$ Mn (III)

16. Ce (III) $\longrightarrow$ Ce (IV)

As examples of other electrolytic reductive reactions which can be carried out at the cathode in accordance with the present invention are the following:

1. $O_2 \longrightarrow 2\,OH$

2.

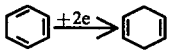

benzene

3.

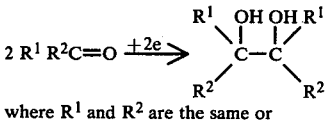

where $R^1$ and $R^2$ are the same or disimilar alkyl or aryl groups.

4.

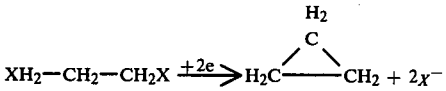

5. $ArX \longrightarrow ArH$ $RX \longrightarrow RH$ where Ar is aryl and R is alkyl 6. $R\,NO_2$ or $ArNO_2 \longrightarrow RNH_2$ or $Ar\,NH_2$ where Ar and R are as in 5 above.

7. $Ar\,NO_2 \longrightarrow Ar{-}\overset{\overset{H}{|}}{N}{-}OH$ where Ar is Aryl

8.

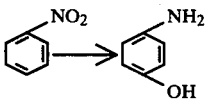

9. $R^1R^2C{=}O \longrightarrow R^1R^2{-}CH_2{-}OH$ where $R^1$ and $R^2$ are as in 3 above.

10. $R_2C{=}O \longrightarrow R_2{-}CH_2$ where R is alkyl

11. $R{-}CN \longrightarrow R{-}CH_2{-}NH_2$ where R is alkyl

12.

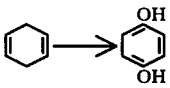

p-hydroxy phenol

13. $-C{=}C \longrightarrow -C{-}C-$

14. $R{-}C{=}C{-}R \longrightarrow R{-}\underset{\underset{H}{|}}{C}{=}\underset{\underset{H}{|}}{C}{-}R$ where R is alkyl -continued 15. $Cr(IV) \longrightarrow Cr(III)$ 16. $Ti(III) \longrightarrow Ti(II)$ 17. $Cl_3-C-\overset{O}{\overset{\|}{C}}-OH \longrightarrow Cl_2-CH-\overset{O}{\overset{\|}{C}}-OH$ The various individual reactions listed above, which can be carried out at the anode or cathode of the cells as described herein, can be carried out in various combinations of paired reactions depending on the various end products desired. For example, if desired, one can carry out oxidative reaction 1 with any of the 27 reductive reactions referred to above. Other paired reactions can be carried out in accordance with the present invention as will be apparent to those skilled in the art from a consideration of the description of this invention.

Before describing the present invention in greater detail, reference is made to the meaning of "anolyte", "catholyte" and "solvent-electrolyte" (also referred to as supplemental electrolyte or bulk solution) as used herein and the appended claims. Anolyte refers to the solution or liquid which is supplied to the porous anode or which is caused to flow in contact with the planar anode employed, and contains, for example, the monoalkyl ester of a lower alkanedioic acid (such as monomethyl adipate) and a solvent therefor, which ester is converted at the anode to a dialkyl ester of an alkanedioic acid (such as dimethyl sebacate). Catholyte refers to the solution or liquid which is supplied to the porous cathode employed, and contains, for example, the activated olefin (such as acrylonitrile) and a solvent therefor, which olefin is converted at the cathode to a hydrodimer of the olefin (such as adiponitrile). Solvent-electrolyte refers to a solvent or liquid which either aids or is inert to the electrolytic reactions taking place at the anode and cathode, preferably free of components or materials which could be electrolytically converted to other materials, and which serves the primary purpose of preventing the anolyte from contacting the cathode and the catholyte from contacting the anode.

Generally, in carrying out the processes of this invention in an undivided cell, free of membranes or porous partitions, the electrolytic reaction conditions are essentially those which are employed in carrying out a single electrolytic reaction at either the anode or cathode for the particular compound which it desired to react. Thus the electrolyte concentrations and temperature, the electrolyte components and the amperage/electrode surface area relationship used in the practice of this invention would be the same or essentially the same as those employed if the electrolytic reactions were being carried out in a cell using a porous membrane apparatus or if the anolyte or catholyte were being subjected to electrolytic reactions individually.

DETAILED DESCRIPTION OF THE INVENTION

The present invention is preferably practiced utilizing an undivided electrolytic cell of the kind illustrated in FIG. 1, and equipped with a porous anode, a porous cathode and a cell frame as hereinbefore described. The cathode employed is preferably a porous carbon electrode plated with metallic lead or cadium. However, other porous cathodes can be used provided they are not consumed by the electrolytic reaction taking place at the cathode. The anode employed is preferably a porous carbon electrode plated with metallic platinum or some other related noble metals. A special case may involve formation of the same product at anode and cathode, but from separate and different reactions.

The cell frame employed, as in FIG. 1, is constructed of a material which does not react with the anolyte, catholyte or solvent electrolyte and does not affect or intefere with the electrolytic reactions carried out in the cell. One suitable material which can be used is rigid polypropylene. However, other rigid plastics can be used provided they are nonconductive or are insulated to be nonconductive, and metals can be used if properly insulated.

In carrying out the electrolytic reaction (EHD) of an activated olefin such as acrylonitrile or ethyl acrylate, as in Equation 1 above, at the porous cathode, the catholyte used can be a solution of the activated olefin in a solution composed primarily of acetonitrile ($CH_3CN$) in water. For best results such catholyte should be neutral to weakly alkaline—a pH, for example, between 7 and 8 being suitable. However, solvents other than acetonitrile and water can be used provided the ingredients employed do not materially affect the EHD reaction. A particularly suitable catholyte contains some water, particularly about 8–15% by volume of water, and about 80–70% by volume of acetonitrile, and the remainder activated olefin.

In the above case, one of the electrolytic reactions which can be carried out simultaneously at the porous anode is the CBW, as in Equation 2 above, wherein, for example, a monoester adipate can be converted to a diester sebacate using a solution of such adipate in a solution composed primarily of acetonitrile in water. Preferably such anolyte should be weakly acidic, suitably at a pH of about 4.0 to about 6.8. Solvents other than acetonitrile and water can be used provided the ingredients therein do not materially affect the decarboxylative dimerization of the monoester adipate. Suitable results can be obtained using an anolyte composed of a 0.5–0.15 M solution of a tetraalkyl quaternary ammonium salt of the monoester adipate being subjected to the decarboxylative dimerization reaction. The solvent-electrolyte in such reaction, is preferably a water solution of such ammonium salt.

Electrolyte temperatures in the range of about 0°–150° C. can be used, but it is preferred to operate the processes with such electrolytes in a temperature range of about 20°–100° C.

Normally the electrolytic processes of this invention are carried out at the prevailing atmospheric pressure, e.g. a standard pressure of 760 mm of mercury. However, it is possible to pressurize the electrolytes used, and thereby incrementally increase electric power utilization efficiency in some instances.

The electric power used can also be varied considerably. For example, it is possible to use a current to anode surface area ratio in the range of about 0.001 A/sq. cm. to about 10 A/sq. cm., but it is preferred to employ from about 10–200 milliampers/sq. cm.

The following specific examples are intended to illustrate the present invention but not to limit the scope thereof, parts and percentages being by weight unless otherwise specified.

EXAMPLE 1

Electrolytic reactions were carried out simultaneously at the anode and cathode of a diaphragmless electrolytic cell as illustrated in FIG. 1 of the attached drawings. This cell contained a three dimensional porous platinum-plated graphite anode (5×1×0.5 cm.) embedded centrally in one wall of a polypropylene cell body (61×15×2.5 cm.) A platinum wire inserted through the back of the cell body, made contact with the anode and supplied electric current thereto. Fitted to each end of the cell body was a 0.5 inch NPT JACO fitting which constituted at one end the entrance to the cell and at the other end the exit to the cell. The area behind the anode was relieved and fitted with a 0.2 inch NPT JACO fitting through which anolyte was supplied through the relieved channel and through the porous anode. An identical cell body, without inlet and exit, was provided as the cathode containing body having a cathode composed of a porous lead-plated graphite electrode. The anode and cathode were positioned so that they were diametrically opposed to each other. The electrodes were spaced from one another and a channel was formed in the cell by use of a 0.25 inch plastic spacer which was placed between the cell bodies. The cell bodies were bolted together to form the cell assembly used.

In operation of the cell, anolyte was pumped by means of a syringe pump to the anolyte channel and through the porous anode and catholyte was pumped by means of another syringe pump to the cathode cavity of the cell and through the porous cathode. The anolyte consisted of a 0.1 M solution of tetramethyl ammonium monomethyl adipate

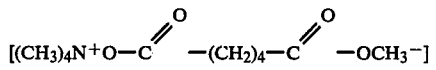

in a solution composed of 90% by volume of acetonitrile and 10% by volume of water. The catholyte consisted of a 0.1 M solution of the same amine as above in a solution of 90% by volume of acetonitrile and 10% by volume of water to which solution was added 10% by volume of ethyl acrylate. Both anolyte and catholyte were caused to flow through their respective electrodes at the rate of 6 milliliters (mls) per minute. In carrying out the electrolytic reaction 1 Ampere of current was supplied to the anode—providing 0.2 A/geometric $cm^2$. At the start of and during the course of the electrolytic reaction a solvent-electrolyte consisting of the above amine in 9cetonitrile and water solution was pumped upward through the channel between the anode and cathode at the rate of 20 mls/min., thus effectively preventing the anolyte from contacting the cathode and the catholyte from contacting the anode. The liquid exiting from the cell was collected and analyzed, and it was found that an 87% yield of dimethyl sebacate (from the monomethyl adipate) was obtained at 35% current efficiency. Also, an 84% yield of diethyl adipate (from the ethyl acrylate) was obtained at 61% current efficiency. No radical adducts were noted in the effluent from the cell.

EXAMPLE 2

Example 1 was repeated using the same conditions and cell except that the cell was provided with a Teflon partition 0.08 cm thick positioned at the downstream edge of the electrodes as in FIG. 3 and exit ports were provided as in FIG. 3, solvent electrolyte was supplied to the cell as in Example 1. Yields of the desired product were substantially comparable to those obtained in Example 1, although it was determined that about 3% of the acrylate in the catholyte had crossed to the anode side of the cell and appeared in the exit anolyte.

EXAMPLE 3

The procedure of Example 1 was repeated and the cell used was the same except that the porous anode was replaced by a flat platinum sheet, as in FIG. 4, of 10.5×5 cm. One Ampere of current was used which resulted in a 0.4 A/$cm^2$ anode current density and a 0.2 A/$cm^2$ cathode current density. The yield of dimethyl sebacate was 91% at a current efficiency of 45% while the yield of diethyl adipate was 86% at a current efficiency of 75%

EXAMPLE 4

The procedure of Example 1, using the same cell, was repeated with the following exceptions: the anolyte and catholyte were both supplied through their respective porous electrodes at the rate of 12 mL/min. and the solvent electrolyte (flowing upward through the channel between the electrodes) was supplied at the rate of 30 mL/min. Using these conditions the yield of dimethyl sebacate was 83% at a 47% current efficiency, and the yield of diethyl adipate was 83% at a current efficiency of 81%.

EXAMPLE 5

The procedure of Example 1 was repeated using the same cell except that the catholyte contained 5% by volume of acrylonitrile instead of ethyl acrylate. Using such conditions a 82% yield of dimethyl sebacate was obtained at a current efficiency of 32% and 78% yield of adiponitrile was obtained at a current efficiency of 69%.

In Examples 3 through 5, no radical adducts were observed and this indicates that very little, if any, of the activated olefin in the catholyte contacted the anode.

It will be apparent to those skilled in the art, from a consideration of the foregoing description, that various changes may be made in the cell arrangements or designs, in the electrolytic reaction conditions, and in the compounds to be processed without departing from the intent and scope of the present invention. For example, it is possible to use a multitude of cells using the same cell design or to use abutting cells in which the dividing wall between the cells have an anode on one side and a cathode on the other side.

What is claimed is:

1. A process of carrying out useful electrolytic reactions simultaneously at an anode and cathode which comprises supplying a catholyte containing a compound to be reduced electrolytically to a cathode in a diaphragmless cell, supplying an anolyte containing a compound to be oxidized electrolytically to the anode in said cell, while imposing an electric current on said anode and cathode of said cell in an amount, rate and location of said cell sufficient to prevent the anolyte from substantially contacting the cathode and to prevent substantially the catholyte from from contacting the anode, and effecting oxidation of the said compound to be oxidized and reduction of the said compound to be reduced in separate useful simultaneous electrolytic reactions.

2. A process as in claim 1, in which the cell is provided with a porous anode and a porous cathode.

3. A process as in claim 2, in which the cell is also provided with a cell frame which substantially prevents intermingling of the anolyte contacting the anode and the catholyte contacting the cathode.

4. A process of carrying out useful electrolytic reactions simultaneously at an anode and cathode which comprises supplying a catholyte containing a compound to be reduced electrolytically to a porous cathode in a diaphragmless cell, supplying an anolyte containing a compound to be oxidized electrolytically to a porous anode in said cell, while imposing an electric current on said anode and cathode of said cell in an amount, rate and location of said cell sufficient to prevent the anolyte from substantially contacting the cathode and to prevent substantially the catholyte from contacting the anode, said process being further characterized in that the cell is provided with a frame which substantially prevents intermingling of the anolyte contacting the anode and the catholyte contacting the cathode, and the catholyte contains an activated olefin to be electrolytically converted to a hydrodimer of said olefin and the anolyte contains the mono alkyl ester of an alkyl dioic acid to be converted to the dialkyl ester of the decarboxylated dimer of said acid.

5. A process as in claim 1, in which the cell is provided with one porous electrode and one planar electrode.

6. A process as in claim 1, in which the cell is provided with a planar anode and a planar cathode, and the anolyte is supplied to the anode just before the upstream edge thereof and the catholyte is supplied to the cathode just before the upstream edge thereof.

7. A process of carrying out electrolytic reactions simultaneously at an anode and cathode which comprises supplying a catholyte containing an activated olefin to be dimerized to a porous cathode in a diaphragmless cell, supplying an anolyte containing the mono alkyl ester of an alkyl dioic acid to a porous anode of said cell, while imposing an electric current on the anode and cathode of said cell, and supplying a solvent electrolyte to said cell in an amount, rate and location of said cell sufficient to prevent substantially the catholyte from contacting the anode and to prevent substantially the anolyte from contacting the cathode.

8. A process as in claim 7 in which said activated olefin is selected from the group consisting of acrylonitrile and lower alkyl acrylate and said monoalkyl ester is the mono methyl adipate.

9. A process as in claim 8, in which the cell is also provided with a cell frame which substantially prevents intermingling of product streams from the anode and the cathode.

10. The process of claim 1 in which the stated useful electrolytic reactions cannot effectively be carried out while substantially avoiding the formation of undesirable by-products, by general electrolysis procedures in an undivided cell.

* * * * *